US008599119B2

(12) United States Patent
Hosogi et al.

(10) Patent No.: US 8,599,119 B2
(45) Date of Patent: Dec. 3, 2013

(54) BACKLIGHT DEVICE AND DISPLAY DEVICE

(75) Inventors: Koji Hosogi, Hiratsuka (JP); Junichi Maruyama, Yokohama (JP); Misa Owa, Kokubunji (JP); Kikuo Ono, Mobara (JP); Goki Toshima, Tachikawa (JP); Masahiro Fukata, Fujisawa (JP)

(73) Assignees: Hitachi Displays, Ltd., Chiba (JP); Panasonic Liquid Crystal Display Co., Ltd., Hyogo-Ken (JP)

( * ) Notice: Subject to any disclaimer, the term of this patent is extended or adjusted under 35 U.S.C. 154(b) by 589 days.

(21) Appl. No.: 12/778,281

(22) Filed: May 12, 2010

(65) Prior Publication Data

US 2010/0289735 A1 Nov. 18, 2010

(30) Foreign Application Priority Data

May 14, 2009 (JP) ..... 2009-117541

(51) Int. Cl.

| | |
|---|---|
| ***G09G 3/32*** | (2006.01) |
| ***G09G 3/36*** | (2006.01) |
| ***H05B 37/02*** | (2006.01) |
| ***H05B 41/36*** | (2006.01) |

(52) U.S. Cl.

USPC ..... 345/82; 345/102; 315/291; 315/247

(58) Field of Classification Search

USPC ..... 345/87, 89, 90, 91, 92, 93, 99, 101, 345/102, 214, 82; 362/97.1, 97.2, 97.3; 315/247, 291

See application file for complete search history.

(56) References Cited

U.S. PATENT DOCUMENTS

| | | | | |
|---|---|---|---|---|
| 6,822,403 | B2 | 11/2004 | Horiuchi et al. | |
| 7,317,403 | B2 * | 1/2008 | Grootes et al. | 340/815.45 |
| 7,864,142 | B2 | 1/2011 | Tanahashi et al. | |
| 8,169,161 | B2 * | 5/2012 | Szczeszynski et al. | 315/308 |
| 2007/0188427 | A1 * | 8/2007 | Lys et al. | 345/82 |
| 2008/0088254 | A1 * | 4/2008 | Yang | 315/247 |
| 2008/0258636 | A1 * | 10/2008 | Shih et al. | 315/185 R |
| 2009/0021183 | A1 * | 1/2009 | Ye et al. | 315/291 |
| 2009/0201669 | A1 | 8/2009 | Hamada | |

FOREIGN PATENT DOCUMENTS

| | | |
|---|---|---|
| JP | 2006-245307 | 9/2006 |
| JP | 2007-27316 | 2/2007 |
| JP | 2008-096902 | 4/2008 |
| JP | 4177022 | 8/2008 |

* cited by examiner

*Primary Examiner* — Quan-Zhen Wang
*Assistant Examiner* — Michael J Eurice
(74) *Attorney, Agent, or Firm* — Antonelli, Terry, Stout & Kraus, LLP.

(57) ABSTRACT

A resistive element is connected in series to a cathode terminal of an LED light source at a last stage (or an anode terminal of an LED light source at a first stage) of an LED chain, and a resistance value of the resistive element is configured to be variable in resistance value in accordance with a variation of voltage drops of the LEDs connected in series so that a resistance value of a resistive element connected to an LED chain having a large voltage drop has a smaller resistance value then a resistance value of a resistive element connected to an LED chain having a small voltage drop. With this configuration, the power, which has been wasted otherwise as heat in the backlight driver IC, may be dispersed to the resistive elements.

4 Claims, 4 Drawing Sheets

FIG.4

| LED CHAIN NUMBER | | LED CHAIN 1 | LED CHAIN 2 | LED CHAIN 3 | ~ | LED CHAIN 8 |
|---|---|---|---|---|---|---|
| VOLTAGE DROP [V] | LED1 | 3. 5 | 3. 0 | 3. 0 | ~ | 3. 0 |
| | LED2 | 3. 5 | 3. 0 | 3. 0 | ~ | 3. 0 |
| | LED3 | 3. 5 | 3. 0 | 3. 0 | ~ | 3. 0 |
| | LED4 | 3. 5 | 3. 0 | 3. 0 | ~ | 3. 0 |
| | LED5 | 3. 5 | 3. 0 | 3. 0 | ~ | 3. 0 |
| | LED6 | 3. 5 | 3. 0 | 3. 0 | ~ | 3. 0 |
| | LED7 | 3. 5 | 3. 0 | 3. 0 | ~ | 3. 0 |
| | LED8 | 3. 5 | 3. 0 | 3. 0 | ~ | 3. 0 |
| | TOTAL | 28. 0 | 24. 0 | 24. 0 | ~ | 24. 0 |

BACKLIGHT DEVICE AND DISPLAY DEVICE

CLAIM OF PRIORITY

The present application claims priority from Japanese patent application JP 2009-117541 filed on May 14, 2009, the content of which is hereby incorporated by reference into this application.

BACKGROUND OF THE INVENTION

1. Field of the Invention

The present invention relates to a backlight device including a backlight module including a plurality of LED chains each being formed of light emitting diodes (LEDs) connected in series and a backlight driver integrated circuit (IC) for driving the plurality of LED chains, and to a display device including the backlight device and a display panel for displaying video by adjusting the transmittance of light from a light source.

2. Description of the Related Art

In recent years, thinning of a liquid crystal display device using a liquid crystal display is advancing. FIG. 1 is a schematic block diagram of a liquid crystal display device. The liquid crystal display device mainly includes four modules. The first module is a liquid crystal display panel module 104 formed of two glass substrates sealing liquid crystal therebetween, in which a voltage is supplied to the liquid crystal so as to change inclination of the liquid crystal molecules, to thereby change the transmittance of light (modulation degree of light passing through the liquid crystal). In the liquid crystal display panel module 104, liquid crystal cells forming pixels are aligned two-dimensionally, and the liquid crystal cells are each sequentially controlled so that the transmittance of light may be changed two-dimensionally.

A panel driver 107 is a module for controlling the liquid crystal display panel module 104. The panel driver 107 synchronizes and outputs display data to the liquid crystal display panel module 104.

The third module is a backlight module 100, which is disposed on a rear surface of the liquid crystal display panel module 104 so as to be used as a light source for applying illumination light. The illumination light is supplied from the rear surface of the liquid crystal display panel module 104 so that the liquid crystal display performs display. The fourth module is a backlight driver 105 for controlling and driving the backlight module 100.

Conventionally, a cold cathode fluorescent lamp (CCFL) has been widely used as a light source of the backlight module. In recent years, however, a light emitting diode (LED) is also used, instead of the CCFL, as a light source of the backlight. The LED is easily controllable in terms of on-off control of the light emitting periods, and the light emission amount thereof may also be controlled with ease by controlling the amount of current. Accordingly, as compared with the CCFL, the LED is capable of attaining low power consumption. Further, the LED is smaller in physical configuration as compared with the CCFL, and hence the light source region to be illuminated by one LED element may be reduced in area. It should be noted that the LED is a point light source, and hence it is necessary to provide an optical member on the circumference of the LED so as to diffuse in plane the light emission amount of the LED so that a uniform luminance may be attained in a planar direction.

FIG. 2 illustrates an example of how the LEDs are connected in a case where the LEDs are used as a backlight. As an example of how the LEDs are connected in a case where the LEDs are used as a backlight, as illustrated in FIG. 2 and as disclosed in JP 4177022 B, a power supply circuit 110 for supplying voltage, a plurality of LEDs 101, and a field-effect transistor (FET) switch 113 which operates as a constant current source for adjusting an amount of current are connected in series with respect to one LED chain, and the FET switch 113 is turned on and off so as to allow a constant current to flow through the LED chain, to thereby turn on and off the LEDs 101. The FET switch 113 is disposed inside a backlight driver IC 111. Further, one backlight driver IC 111 includes therein a plurality of the FET switches 113 so as to respectively control the plurality of LED chains.

Here, the LEDs 101, which are light emitting elements, have a feature in that a degree of voltage drop significantly varies from one element to another. In a case where a plurality of LEDs 101 are connected to one LED chain and the plurality of the LED chains are driven by one backlight driver IC 111 while the LEDs 101 significantly vary from one another in voltage drop, the backlight driver IC 111 consumes power as heat.

In view of the above, as disclosed in JP 2006-245307 A, a protective transistor is connected in series to each of the LED chains, and a base terminal of the protective transistor is supplied with a predetermined voltage, to thereby limit an input voltage input to the backlight driver IC, so as to suppress heat generated in the backlight driver IC.

As disclosed in JP 2006-245307 A, when the protective transistor is inserted with respect to one LED chain, the input voltage to the backlight driver IC may be limited and heat generated in the backlight driver IC itself may be suppressed. However, power consumption results from an ON resistance of the protective transistor itself. Accordingly, power is consumed to the amount corresponding to the ON resistance, regardless of whether or not there is a variation in voltage drop among the LEDs. In the LED, a current of several tens of mA needs to be supplied, which increases the power consumption resulting from the ON resistance, leading to a reduction in power efficiency in the entire module.

SUMMARY OF THE INVENTION

It is an object of the present invention to provide a backlight device including: a backlight module including a plurality of LED chains each being formed of a plurality of LED light sources connected in series; and a backlight driver IC including a plurality of FET switches for driving the plurality of LED chains, which is capable of suppressing an increase in power consumption of an LED backlight driver resulting from LED light sources which greatly vary from one another in voltage drop.

A backlight device according to the present invention includes: a backlight module including a plurality of LED chains each being formed of a plurality of LED light sources connected in series; and a backlight driver IC including a plurality of FET switches for driving the plurality of LED chains, respectively, in which: the backlight device further includes a plurality of resistive elements each connected in series to one of an anode terminal of an LED light source at a first stage and a cathode terminal of an LED light source at a last stage of each of the plurality of LED chains, the plurality of LED chains and the plurality of resistive elements forming a plurality of series circuits; the backlight device further includes a power supply circuit connected to a first stage side of the plurality of series circuits formed of the plurality of LED chains and the plurality of resistive elements; and the plurality of series circuits formed of the plurality of LED chains and the plurality of resistive elements are each connected, on a last stage side thereof, to a drain terminal of each of the plurality of FET switches. The plurality of resistive elements are each configured to be variable in resistance value in accordance with a variation of voltage drops of the LEDs connected in series, and a resistive element, of the plurality of resistive elements, connected to an LED chain having a large voltage drop has a small resistance value, and a resistive element, of the plurality of resistive elements, connected to an LED chain having a small voltage drop has a large resistance value. With this configuration, the power, which has been wasted otherwise as heat in the backlight driver IC, may be dispersed to the plurality of resistive elements.

More preferably, a resistive element connected to an LED chain having a largest voltage drop value may desirably have a resistance value of substantially zero ohms, and a resistive element connected to another LED chain than the LED chain having the largest voltage drop value may desirably have a resistance value obtained by dividing a difference between the voltage drop value of the LED chain having the largest voltage drop value and a voltage drop value of the another LED chain by a current value flowing through the another LED chain. With this configuration, the power efficiency may further be increased.

Further, the power supply circuit may supply a power supply voltage satisfying a voltage to be consumed by the LED chain that has the largest voltage drop value.

Alternatively, the resistive element may be a variable resistive element, which may be adjustable in resistance value for each LED chain.

According to the present invention, the power, which has conventionally been wasted otherwise as heat in the backlight driver IC due to the variation in voltage drop among the LEDs, may be dispersed to the resistive elements disposed outside the backlight driver IC. Further, power consumption resulting from an ON resistance of a protective transistor connected in series to each LED chain, which has conventionally been consumed regardless of whether or not there is a variation among the LEDs, may be reduced.

BRIEF DESCRIPTION OF THE DRAWINGS

In the accompanying drawings:

FIG. 4 is a table illustrating an example of how a voltage drop varies among LEDs used as the backlight.

DETAILED DESCRIPTION OF THE INVENTION

In the following, an embodiment of the present invention is described in detail with reference to the accompanying drawings.

First, a basic configuration and operation of the embodiment of the present invention is explained, and then a specific description of the embodiment is given.

First, a basic configuration of a display device according to the embodiment of the present invention is described.

Figure 1:
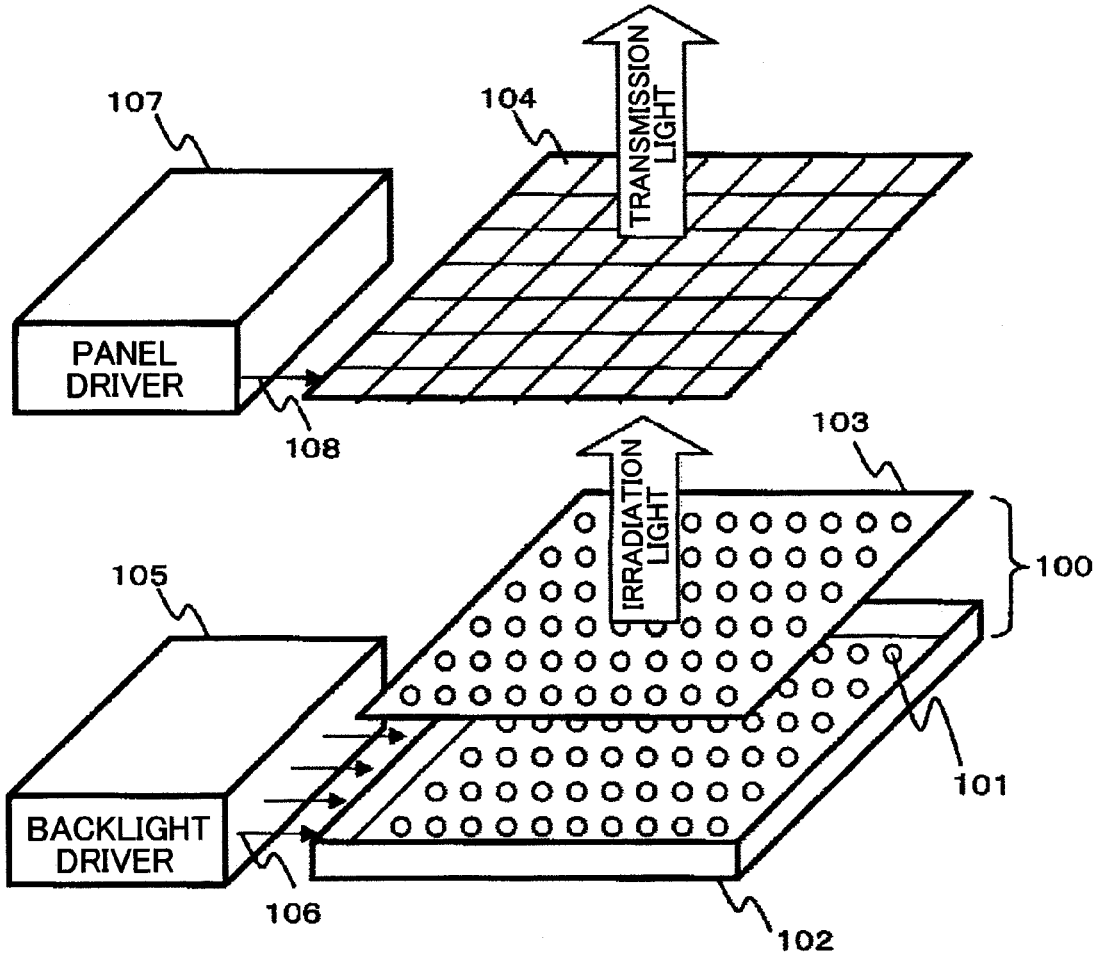
FIG.1 (Prior Art)
FIG. 1 illustrates a configuration example of a display panel, a backlight, and a controller in a display device to which the present invention is applied.
Figure 2:
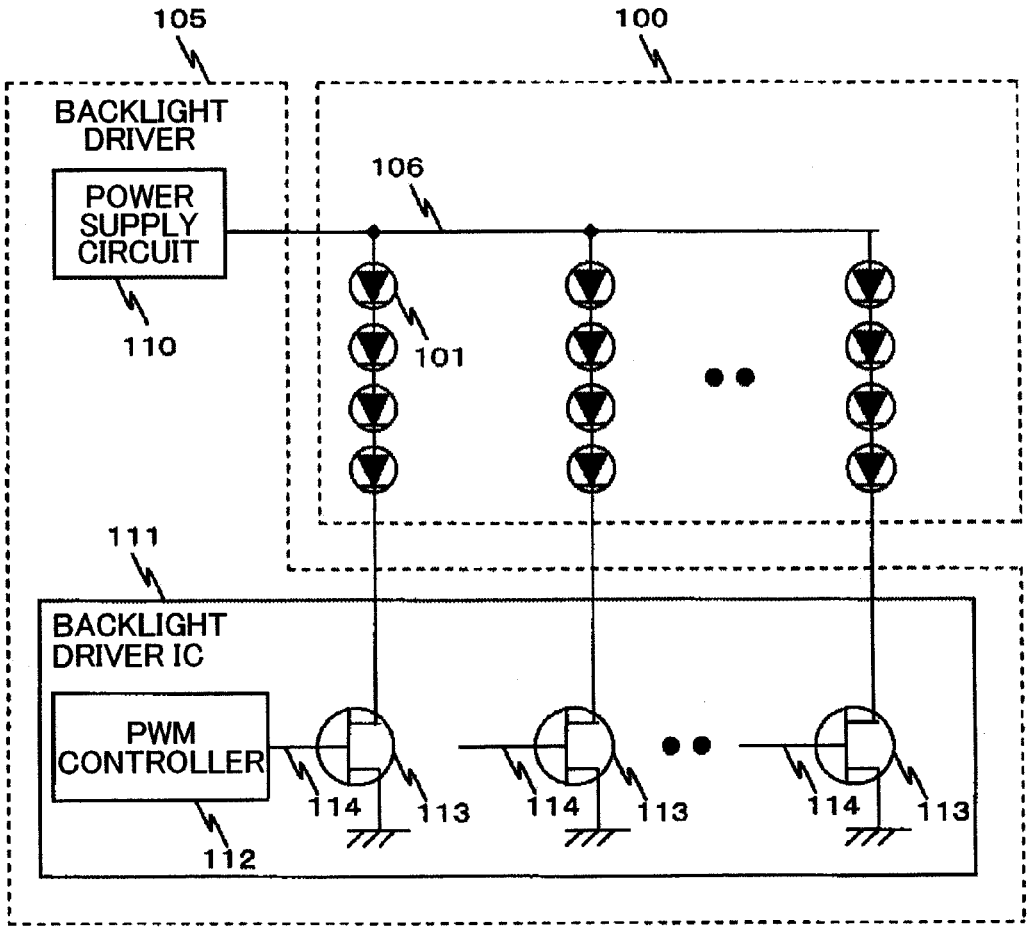
FIG.2 (Prior Art)
FIG. 2 is a diagram for illustrating an example of how to connect LEDs in a case of using the LEDs as the backlight.

FIG. 1 illustrates a configuration example of a display panel, a backlight, and a controller in a display device to which the present invention is applied. Each of the members is illustrated as being separated from one another for describing constituent members. Those members are assembled in practice so as to configure the display device.

The display device is, for example, a display device such as a television receiver, which is typified by a liquid crystal display device provided with a function of receiving various kinds of video data as an input and displaying the data.

The display device includes four major constituent elements, namely, a backlight module 100, a backlight driver 105 for controlling driving of the backlight module 100, a display panel 104 formed of a liquid crystal panel, and a panel driver 107 for controlling the display panel 104. The display panel 104 is, for example, a liquid crystal display panel, in which a plurality of liquid crystal elements serving as pixels (display units) are arranged in matrix, and each pixel may be individually controlled in transmittance according to a liquid crystal panel control signal 108 supplied from the panel driver 107.

The backlight module 100 has a function of illuminating the display panel 104, and is formed of a plurality of light sources 101, a frame 102, an optical member 103, and the like. The light sources 101 in the backlight module 100 emit light in accordance with a power supply voltage 106 input from the backlight driver 105. Here, the light sources 101 are, for example, light emitting diodes (LEDs), which are arranged on the frame 102 at predetermined intervals. The optical member 103 includes an optical member such as a diffusion sheet for uniformalizing the intensity of light applied from the light sources 101 or a brightness enhancement film for enhancing light extraction efficiency.

In the display device according to this embodiment, light applied by the backlight module 100 partially passes through each pixel of the display panel 104 so as to assemble as transmission light for forming a video image eventually displayed by the display device. In other words, the display luminance eventually obtained for each pixel of the display device may be calculated by multiplying the transmittance of each pixel of the display panel by the luminance (intensity of the irradiation light) in a region of the backlight corresponding to the pixel.

Figure 3:
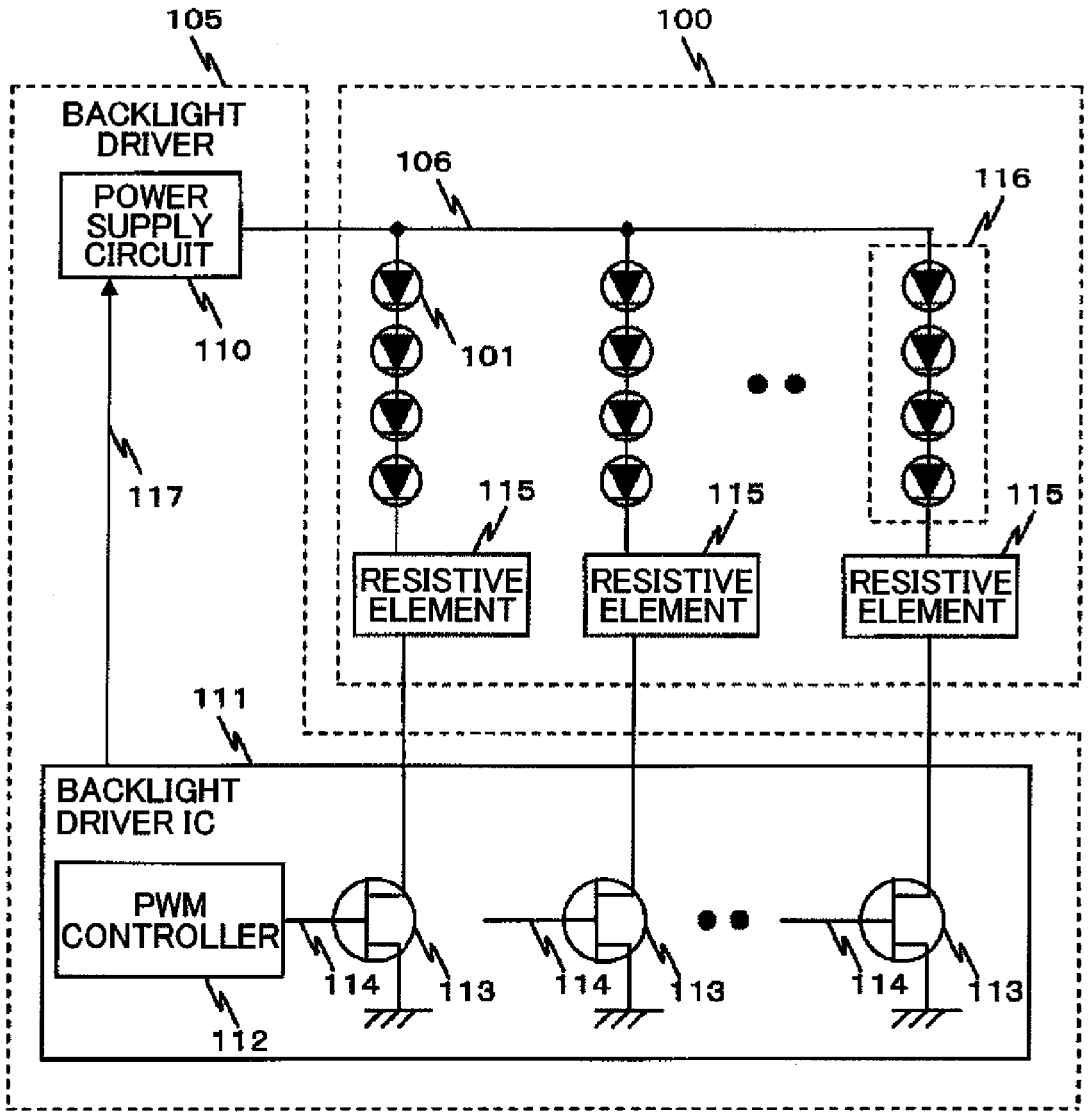
FIG. 3 illustrates how a backlight driver and a backlight module are connected according to an embodiment of the present invention.

FIG. 3 illustrates how the backlight driver 105 and the backlight module 100 are connected in this embodiment.

The backlight module 100 has a plurality of the LEDs 101 arranged in a grid pattern. In this embodiment, an LED chain 116 in which a plurality of LEDs 101 are connected in series and a resistive element 115 which is connected in series to a cathode terminal side of the LED at the last stage of the LED chain 116 form a series circuit of the LED chain 116 and the resistive element 115. It should be noted that the resistive element 115 may be connected to an anode terminal side of the LED at the forefront (first stage), which is on an input terminal side, of the LED chain 116. Here, the resistance value of the resistive element 115 to be connected may be reduced to substantially zero ohms at minimum. A plurality of the LED chains 116 are arranged in parallel with one another in the backlight module 100, and the input sides (first stage sides) of the LED chains 116 are all short-circuited and connected to a power supply circuit 110 so as to be supplied with the power supply voltage 106. The output terminal sides (last stage sides) of the LED chains 116 are each input to a backlight driver IC 111.

The backlight driver 105 includes the power supply circuit 110 for supplying the power supply voltage 106 to the LEDs 101, and the backlight driver IC 111 connected with the output terminals of the LED chains 116. The output terminals of the LED chains 116 are respectively connected to drain terminals of FET switches 113, and source terminals of the FET switches 113 are connected to ground (GND). Gate terminals 114 of the FET switches 113 are connected to a pulse width modulation (PWM) controller 112 for performing control on pulse width modulation. The pulse width modulation refers to control performed so as to regulate periods for supplying a current to the LED chains 116. The light emission amount of the LED 101 is proportional to a value of a current flowing through the LED 101 and the time during which the current flows. Accordingly, when the current supply time is controlled by the pulse width modulation, the light emission amount may be controlled.

The backlight driver IC 111 has a plurality of the FET switches 113 arranged therein, which are respectively connected to the LED chains 116. The PWM controller 112 individually controls the pulse width modulation of each of the LED chains 116, to thereby attain area modulation for each of the LED chains 116.

Meanwhile, the backlight driver IC 111 outputs a feedback signal 117 indicating an amount of power supply, to the power supply circuit 110. In accordance with the feedback signal 117, the power supply circuit 110 supplies the power supply voltage 106 satisfying the voltage to be consumed by the LED chain 116 that has a largest voltage drop.

FIG. 4 is a table illustrating an example of how the voltage drop varies among the LEDs 101 used as the backlight. This example takes an exemplary case where the number of the LED chains is 8, and eight LEDs 101 are connected in series to each of the eight LED chains 116. The eight LED chains 116 are controlled by one backlight driver IC 111. It should be noted that the number of LED chains, and the number of LEDs connected to the LED chains are not specifically limited.

The LEDs connected to the LED chain 1 each have a voltage drop of 3.5 [V], which sums up to 3.5 [V]×8=28.0 [V]. The LEDs of the LED chains 2 to 8 each have a voltage drop of 3.0 [V], which sums up to 24.0 [V] for each LED chain. In this case, the power supply circuit 110 supplies a voltage of 29.0 [V] which is the sum of a voltage of the LED chain 1, which is 28.0 [V], and a voltage consumed by the FET switch 113 (assumed to be 1.0 [V]). The voltage of 29.0 [V] is supplied to each of all the LED chains, which means that the LED chains 2 to 8 are each supplied with an excess current of 4.0 [V], and the excess of supply is consumed as heat. For example, in a case where a current value flowing through each of the LED chains is 50 [mA], the seven FET switches 113 connected to the LED chains 2 to 8 each consume 0.2 [W] (4.0 [V]×50 [mA]), with the result that the backlight driver IC 111 as a whole consumes 0.2 [W]×7 switches, that is, 1.4 [W], as heat. Accordingly, the backlight driver IC 111 requires a package capable of allowing excessive permissible dissipation, and a similar allowance is required for a printed circuit board on which the backlight driver IC 111 is to be disposed on.

Here, a consideration is given to the resistive element 115 illustrated in FIG. 3. The LED chain 1 is connected with a resistance of substantially zero ohms, while the LED chains 2 to 8 are each connected with a resistance of 80Ω. The resistance of 80Ω corresponds to a value obtained by dividing 4.0 [V], which is the difference between the voltage drop value of 28.0 [V] of the LED chain 1 having a largest voltage drop value and the voltage drop value of 24.0 [V] of each of the LED chains 2 to 8, by 50 [mA] which is a current value flowing through each of the LED chains 2 to 8. In a case where the resistive element 115 has a resistance value of 80Ω and a current value of 50 [mA], the resistive element 115 causes a voltage drop of 4.0 [V], which is the product of the resistance value and the current value. On the other hand, the resistive element 115 connected to the LED chain 1 has a resistance value of substantially zero ohms, and hence causes no voltage drop. When those resistive elements 115 described above are used in combination, the FET switches 113 in the backlight driver IC 111 are each supplied with the same voltage (1 [V]), without causing heat dissipation due to excessive supply of voltage to occur. With this configuration, the power consumed as heat in the backlight driver IC 111 is dispersed to the resistive elements 115. Accordingly, the resistive element 115, or a transistor element to be used in place of a resistor, may desirably be disposed to one of the input side and the output side of the LED chains 116, rather than being disposed in the backlight driver IC 111. It should be noted that, according to the description of this embodiment, the resistive element 115 is disposed in the backlight module 100, which may be disposed in the backlight driver 105 instead.

As described above, this embodiment has a feature in that the plurality of LED chains 116 controlled by one backlight driver IC 111 are each connected in series with the resistive elements 115 which are different from each other in resistance value. Specifically, the resistive element 115 connected to the LED chain 116 having a large voltage drop has a small resistance value while a resistive element connected to the LED chain 116 having a small voltage drop has a large resistance value.

Preferably, the resistive element 115 connected to an LED chain having a largest voltage drop may desirably have a resistance value of substantially zero ohms, while a resistive element connected to another LED chain than the LED chain having a largest voltage drop may desirably have a resistance value obtained by dividing the difference between the voltage drop value of the LED chain having a largest voltage drop value and the voltage drop value of the another LED chain by a current value flowing through the another LED chain.

Alternatively, the power supply circuit 110 may supply a power supply voltage satisfying the voltage to be consumed by the LED chain that has a largest voltage drop value.

Further, the resistive element 115 may employ a variable resistor, which may be adjusted in resistance value when binding the backlight module 100 or the backlight driver 105.

While there have been described what are at present considered to be certain embodiments of the invention, it will be understood that various modifications may be made thereto, and it is intended that the appended claims cover all such modifications as fall within the true spirit and scope of the invention.

What is claimed is:

1. A backlight device, comprising:

a backlight module including a plurality of LED chains each being formed of a plurality of LED light sources connected in series; and a backlight driver IC including a plurality of FET switches for driving the plurality of LED chains, respectively, wherein:

the backlight device further comprises a plurality of resistive elements each connected in series to a cathode terminal of an LED light source at a last stage of each of the plurality of LED chains, the plurality of LED chains and the plurality of resistive elements forming a plurality of series circuits;

the backlight device further comprises a power supply circuit connected to a first stage side of the plurality of series circuits formed of the plurality of LED chains and the plurality of resistive elements;

the plurality of series circuits formed of the plurality of LED chains and the plurality of resistive elements are each connected, on a last stage side thereof, to a drain terminal of each of the plurality of FET switches; and a resistance value of a resistive element, of the plurality of resistive elements, connected to an LED chain having a first voltage drop which is a large voltage drop, is smaller than a resistance value of a resistive element, of the plurality of resistive elements, connected to an LED chain having a second voltage drop which is a small voltage drop with respect to the large voltage drop;

wherein a resistive element connected to an LED chain having a largest voltage drop value has a resistance value of substantially zero ohms;

wherein a resistive element connected to another LED chain than the LED chain having the largest voltage drop value has a resistance value obtained by dividing a difference between the voltage drop value of the LED chain having the largest voltage drop value and a voltage drop value of the another LED chain by a current value flowing through the another LED chain;

wherein one side of each of the plurality of resistive elements is connected to the drain terminal of each of the plurality of FET switches, the one side of each of the plurality of resistive elements being opposite to another side of each of the plurality of resistive elements to which each of the plurality of LED chains is connected; and wherein each source terminal of the plurality of FET switches is connected to ground.

2. The backlight device according to claim 1, wherein the power supply circuit supplies a power supply voltage to the plurality of series circuits formed of the plurality of LED chains and the plurality of resistive elements, the power supply voltage satisfying a voltage to be consumed by the LED chain that has the largest voltage drop value.

3. The backlight device according to claim 1, wherein the plurality of resistive elements comprise variable resistors which are variable in resistance value.

4. A display device, comprising:

the backlight device according to claim 1; and a display panel disposed on a front surface of the backlight module of the backlight device.

* * * * *